US005701701A

United States Patent [19]

Desrosiers

[11] Patent Number: 5,701,701

[45] Date of Patent: Dec. 30, 1997

[54] SAFETY GATE

[76] Inventor: Robert M. Desrosiers, 113 Miller St., Middleborough, Mass. 02346

[21] Appl. No.: 698,517

[22] Filed: Aug. 15, 1996

Related U.S. Application Data

[60] Provisional application No. 60/002,886, Aug. 24, 1995.

[51] Int. Cl. [6] ..... E05C 7/06

[52] U.S. Cl. ..... 49/116; 49/73.1; 49/122; 49/449; 160/210

[58] Field of Search ..... 160/210, 212, 160/136–165, 92, 94, 96, 113, 114, 405; 49/149, 152, 93, 94, 96, 95, 97, 116, 122, 197, 381, 388, 73.1, 449

[56] References Cited

U.S. PATENT DOCUMENTS

| | | | |
|---|---|---|---|
| 3,740,022 | 6/1973 | DiGiovanni | 256/24 |
| 4,041,646 | 8/1977 | Mittag | 49/385 |
| 4,300,313 | 11/1981 | Steinke | 49/463 |
| 4,422,264 | 12/1983 | Harris | 49/121 |
| 4,438,596 | 3/1984 | Jones et al. | 49/463 |
| 4,538,379 | 9/1985 | Vargo | 49/385 X |
| 5,241,789 | 9/1993 | Vacelet | 49/248 |
| 5,546,703 | 8/1996 | Conway | 49/388 X |
| 5,592,779 | 1/1997 | Conway | 49/73.1 |

FOREIGN PATENT DOCUMENTS

| | | | |
|---|---|---|---|
| 2354280 | 1/1978 | France | 49/116 |

OTHER PUBLICATIONS

"Roly Safeti–Gate", Association of Mezzamine Manufacturers, Product Brochure.

*Primary Examiner*—David M. Purol
*Attorney, Agent, or Firm*—Bromberg & Sunstein LLP

[57] ABSTRACT

A safety gate is provided for limiting access to a work area. The safety gate includes a linkage pivotally connected to a support, and front and rear gates each being pivotally connected to one end of the linkage. As the linkage pivots about the support to move one gate upward, while moving the other gate downward, each gate remains substantially parallel to one another. The safety gate also includes a latch mechanism for locking the either of the front and rear gates into a particular position.

18 Claims, 5 Drawing Sheets

SAFETY GATE

This application claims priority from U.S. provisional application Ser. No. 60/002,886, filed Aug. 24, 1995, which is hereby incorporated herein by reference.

TECHNICAL FIELD

The present invention relates to safety gates, in particular, gates for use on mezzanine loading platforms.

BACKGROUND OF THE INVENTION

Many warehouses are designed with open mezzanine levels. Forklifts are used to lift pallets loaded with goods for storage on the mezzanine level. Safety regulations require that gates be provided along the edge of the mezzanine level to help deter persons and things from falling off. In order to permit goods to be loaded up onto the mezzanine level, the ability to open the gate on the edge is needed. It is desirable that the gate be able to be opened without standing too close to the mezzanine edge. When the ledge gate is open, it is further desirable to close off the loading area.

One solution to this problem of keeping the edge of the mezzanine level closed off is the Roly® Safeti-Gate. The Roly® Safeti-Gate includes two side gates and a rigid frame with a front and rear gate which pivots in see-saw fashion on the side gates. The rigid frame has trapezoidal sides which support the front and the rear gate at a right angle with respect to each other. When the front gate is down, the rear gate is horizontally located above the workers. When the rear gate is down and vertically positioned to prevent access to workers, the front gate is raised and is oriented horizontally roughly parallel to the mezzanine floor. In accordance with the Roly® Safeti-Gate design, when the rear gate is lifted lowering the front gate, clearance is needed for the rear gate as it swings out and back behind the safety gate area. Moreover, with the rear gate down, the front gate, although raised off the mezzanine floor, overhangs the edge of the mezzanine.

SUMMARY OF THE INVENTION

The present invention is directed to a safety gate in which the front and rear gates are connected by a linkage that pivots at its connection to each of the front and rear gates. The linkage arm between the front and rear gates is pivotally mounted on opposing support posts. The safety gate of the invention operates such that pulling down on one of the front or rear gates causes the other gate to lift. The up and down movement of the front and rear gates is substantially straight up and down and therefore barely requires any additional clearance. Moreover, when a forklift is accessing the mezzanine level with the front gate lifted, the front gate is not extending over the ledge so as to possibly interfere with the forklift. The linkage connecting the front and rear gates may be parallel arm linkages in accordance with a preferred embodiment of the invention. A spring-biased pin may be included on the rear gate to engage one of the linkage arms to maintain the safety gate in a selected position with either the front or rear gate down. The spring-biased pin may also be retracted to change the position of the safety gate. Alternatively, a plate notch lock may be included on the pivotal connection between the linkage and a support post to provide a positive engagement which holds the gate in a closed position with either the front gate down or the rear gate down. The plate notch lock is easily releasable for changing positions of the gate. Side rails are provided to complete an enclosure of the loading area with the rear gate down.

DETAILED DESCRIPTION OF PREFERRED EMBODIMENT

Figure 1:
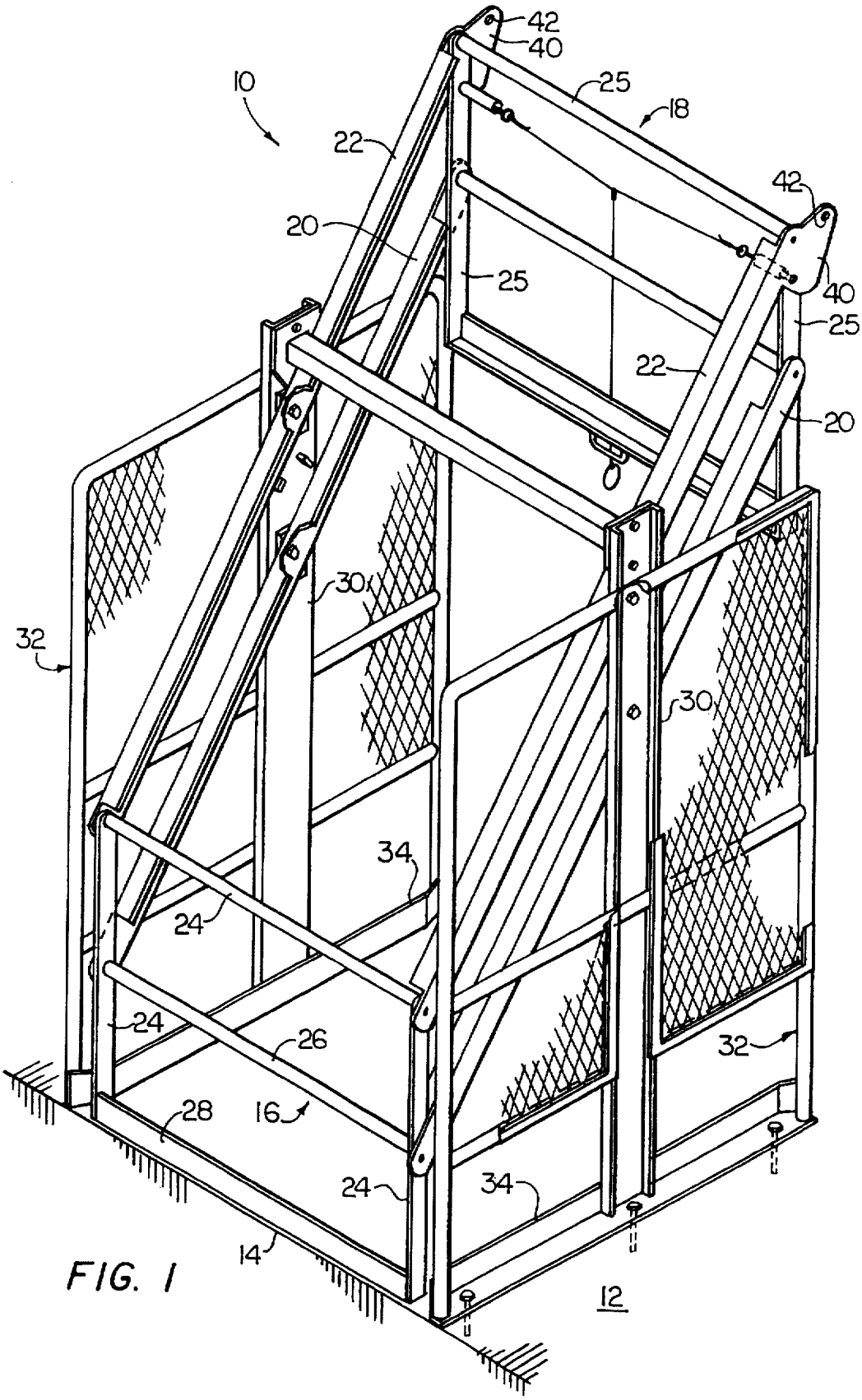
FIG. 1 is an isometric view of the safety gate of the present invention.

Referring now to the drawings, an elevated loading and safety gate 10 of the present invention is shown. The safety gate 10 is particularly adapted for use on an elevated platform such as an open mezzanine level. The safety gate 10 is mounted on the mezzanine floor 12 adjacent the loading edge 14. A front gate 16 and a rear gate 18 are each pivotally connected to a rigid linkage arm 20. In accordance with the presently preferred embodiment, a pair of parallel rigid linkage arms 20, 22 are pivotally connected to the front gate 16 and the rear gate 18. The front gate 16 includes a rectangular frame 24 and a cross piece 26. The cross piece helps add structural strength to the gate. The gate of the presently preferred embodiment provides railings designed to prevent workers from falling off the mezzanine level. If desired, the gate may be made solid. Preferably, along the bottom of the gate 16, a kickplate 28 is included. The kickplate is designed to prevent tools from sliding off the edge of the mezzanine level. The rear gate 18 similarly includes a rectangular frame 25. When the rear gate is in the down position, the gate blocks workers from walking into the receiving area where pallets of goods may be loaded by a forklift.

Preferably the front gate 16 is made heavier with counterweights or the like so that at all times, one gate or the other will be in the down position. If the gates are not locked in one position or the other, the heavier weights on the front gate will pull the front gate 16 down into the down position.

Figure 3:
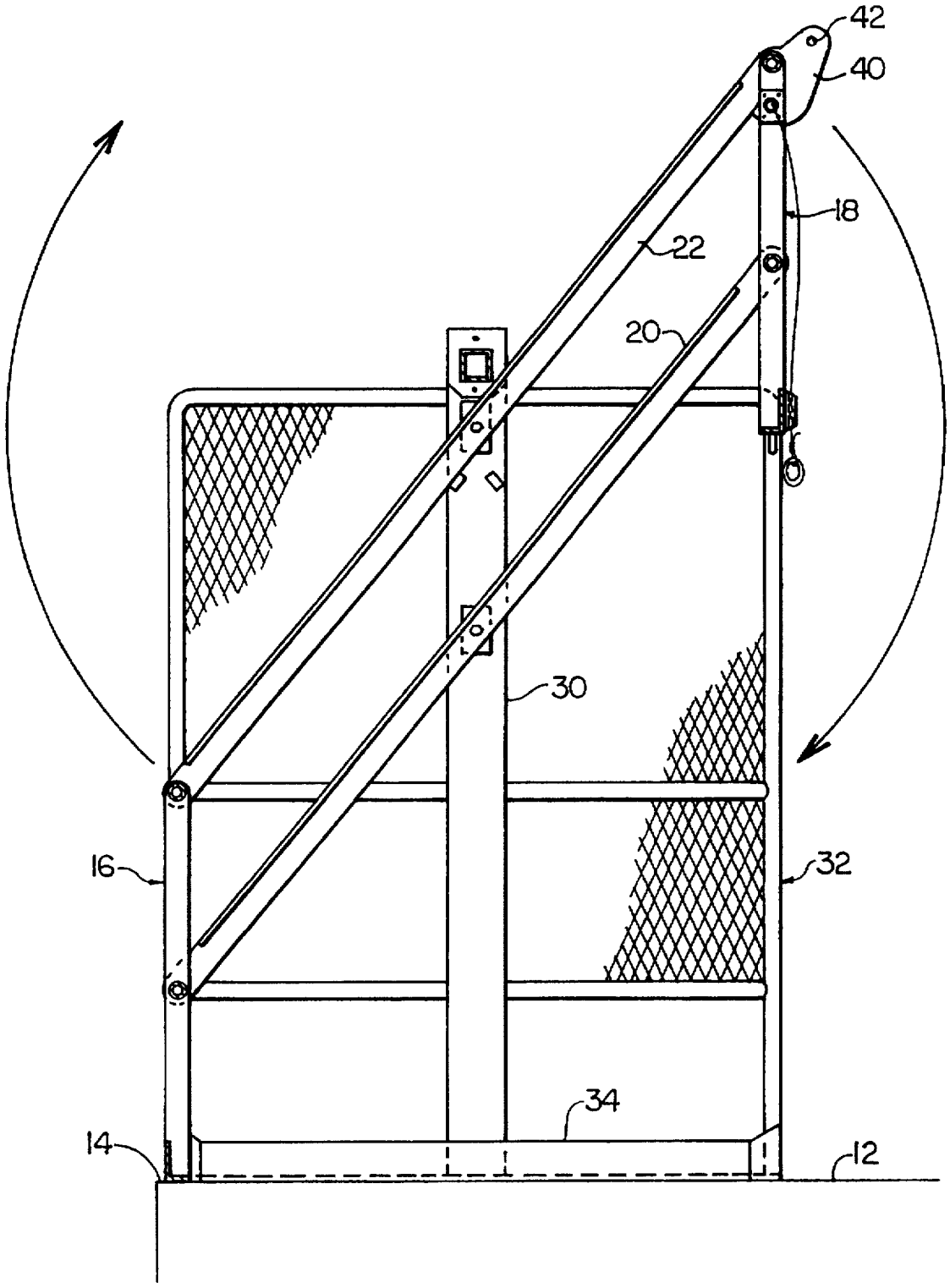
FIG. 3 is a sectional view of the safety gate of FIG. 2 taken along the line III—III.

The parallel linkage arms 20, 22 are pivotally connected to opposing support posts 30. In the presently preferred embodiment, the center of the linkage arm has a hole through which a pivot rod is inserted from the support post. The pivots in the safety gate 10 between the linkage arms 20, 22 and the gates 16, 18, and between the linkage arms 20, 22 and the opposing support posts 30 may be formed in any conventional manner. For example, a bolt, a welded pin, or other alternative well-known pivot device may be used to permit the gates to freely pivot with respect to the linkages and the linkages to pivot about the side supports. By using a pair of parallel linkage arms 20, 22, the vertical orientation of each of the gates may be maintained as the gates are moved up or down. Advantageously, by pivoting the linkage members at each of the gates, very little clearance is required behind the gates for lifting or lowering the gate. In other words, despite the movement of the linkage arms, which may follow an arc as shown in FIG. 3, the front 16 and rear 18 gates, because they are pivotally connected to the linkage arms 20 and 22, are nevertheless able to maintain a position that is substantially perpendicular to the mezzanine floor 12 and substantially parallel to one another. Also in the raised position, each gate is maintained substantially within the footprint of the safety gate 10. Thus there is no overhang beyond the mezzanine level which may interfere with fork-lift operation.

A pair of side gates 32 are provided so as to complete the enclosure of the loading area when the rear gate 18 is down. The side gates 32 may preferably be provided with kick-plates 34 along their bottom edge to prevent small objects from sliding into or out of the loading area. The safety gate is preferably made of structurally sound material such as steel.

Figure 2:
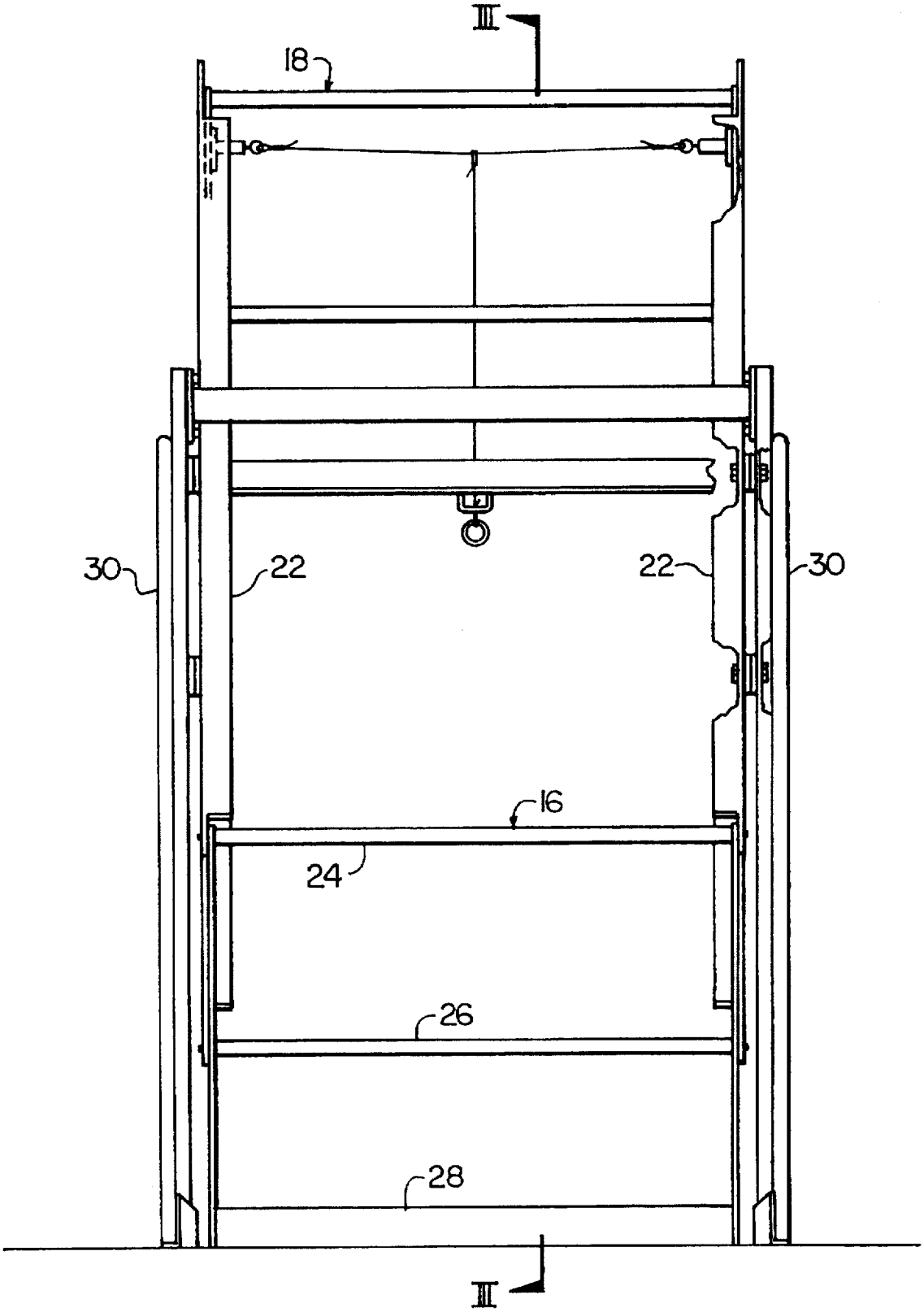
FIG. 2 is a front view of the safety gate of FIG. 1.
Figure 4:
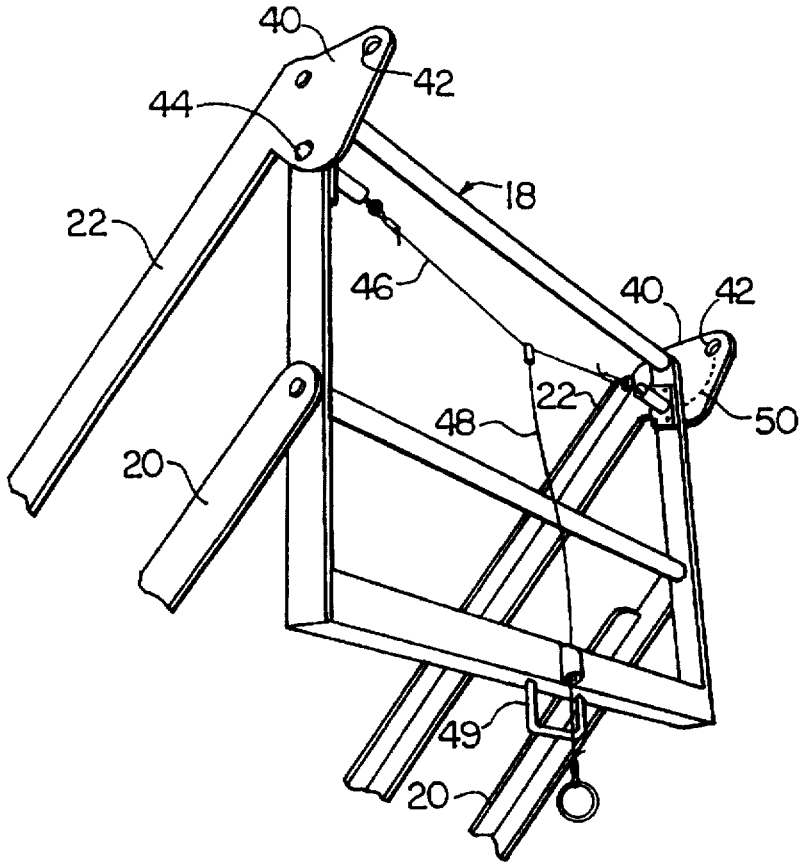
FIG. 4 is an isometric view of a lock mechanism of the safety gate of FIG. 1.
Figure 5:
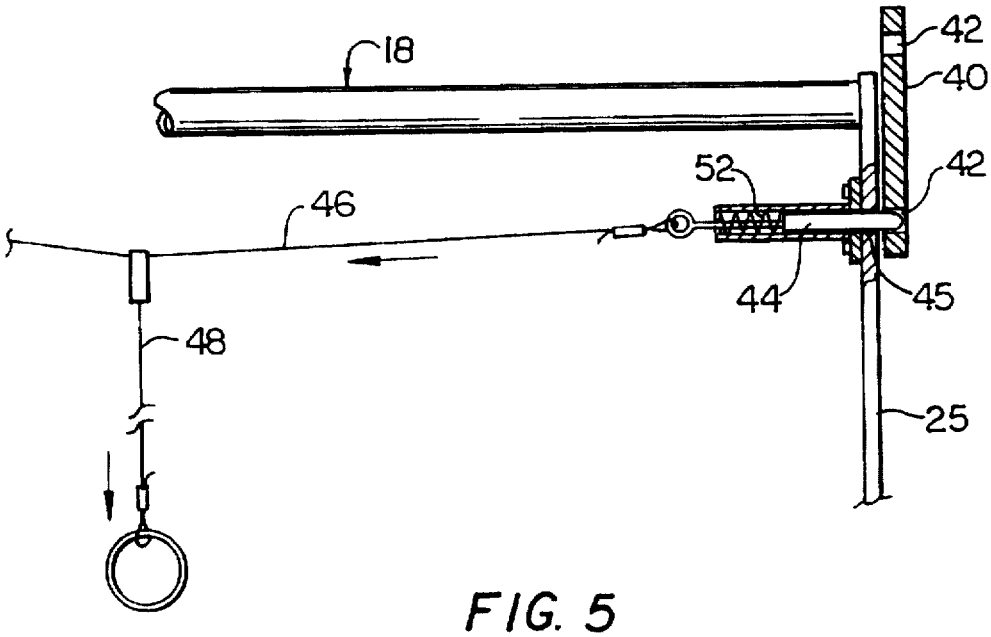
FIG. 5 is a cross-section view of the lock mechanism of FIG. 4.

Referring now to FIGS. 4 and 5, a latch mechanism is desirable in order to maintain the safety gate in its selected position. Without the latch, the extra weight on the front gate will tend to bring the front gate down at all times if there is nothing else hanging onto the safety gate. In one embodiment of the invention, each linkage arm 22 includes a flared extension 40 at an end adjacent to the rear gate 18. The flared extension includes a plurality of holes 42 to provide the safety gate with a selection of latched positions. In a presently preferred embodiment, two holes are used to provide the safety gate with two different latched positions. In one latched position, the front gate 16 is down, while the rear gate 18 is up. In a second latched position, the opposite is true with the rear gate 18 being down and the front gate 16 being up. To maintain the safety gate in one of the two latched positions, the rear gate 18, as shown in FIG. 5, is provided with a spring-biased pin 44 for engaging either of the holes 42 on the extension 40. Where the spring-biased pin 44 is coupled to frame 25, an aperture 45 is provided in the frame 25 so that, when the aperture 45 is in alignment with a particular hole 42, the pin 44 may extend through the aperture, across the frame, and into engagement with the particular hole 42. Although FIG. 4 illustrates the use of two pins 44, each to engage the holes 42 in each extension 40, the present invention contemplates that only one such pin and one such extension may be necessary for maintaining the safety gate in one of the two latched positions. To disengage the pins 44 from the holes 42 the safety gate, a cable 46 is provided in one embodiment of the invention. Cable 46 is preferably attached at each of its ends to an end of each of the pins 44, so that when the cable 46 is pulled in the direction of the arrow, each pin 44 may be simultaneously retracted toward one another and out from the respective hole 42. In order to better facilitate the pulling of cable 46, a second cable 48 may be provided at about a mid-point of cable 46 so that when the second cable 48 is pulled, cable 46 may be similarly pulled to retract the pins in a direction toward one another. Once each pin is retracted from the respective hole 42, the position of the gates may be changed. For instance, if the rear gate 18 is initially in an up position, as shown in FIGS. 2–4, it may now be lowered. Since the front gate 16 is heavier than the rear gate 18, a handle 49 may be used to permit a good grip on the rear gate 18 during the lowering process. As the rear gate 18 is being lowered, the linkage arms 20 and 22 pivot about the support posts 30 to permit each retracted pin 44 to follow a path 50 along the extension 40. When each of the apertures 45 in the rear gate 18 becomes aligned with the next corresponding hole 42 on the extension 40, the pin 44 is pushed into an extended position by a spring 52 to engage the hole 42. In this manner, the rear gate 18 may be locked into the down position.

Figure 6:
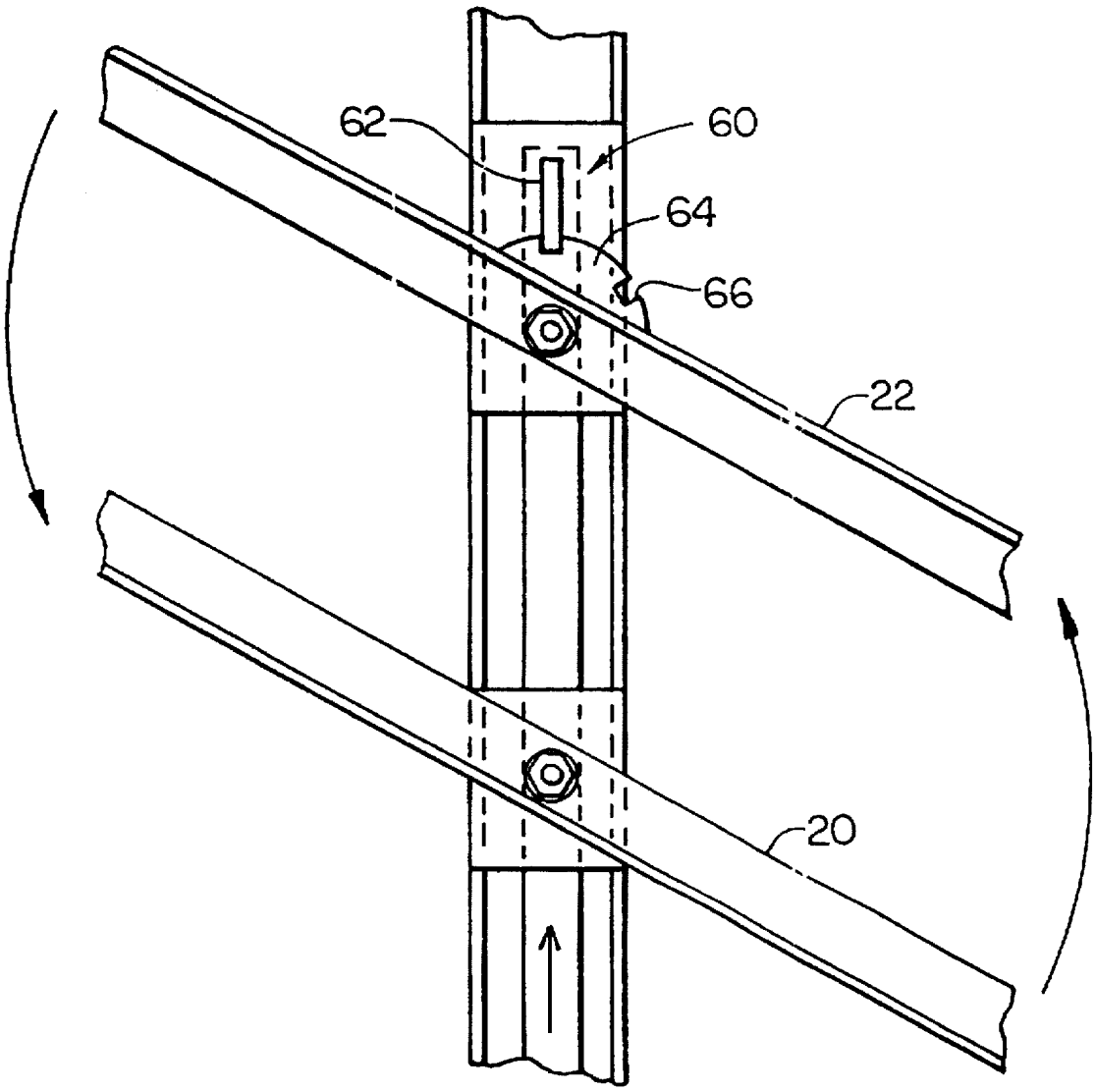
FIG. 6 is a side view of an alternate lock mechanism of the safety gate of FIG. 1

Referring now to FIG. 6, an alternate latch mechanism may also be used in order to maintain the safety gate 10 in its selected position. As shown in FIG. 6, plate notch lock 60 is provided by the present invention on the linkage arm 22 to permit a selection of one of two latched positions. A first position is with the front gate down and the rear gate up. A second position is the opposite with the front gate up and the rear gate down. The plate notch lock 60 includes a locking pin 62 and a notched plate 64. The notched plate 64 is fixedly attached to one or more of the rigid linkage arms 20, 22. The plate 64 has a rounded outer periphery having a pair of notches 66 therein. The locking pin 62 rides along the rounded periphery when the position of the safety gate is changed. The locking pin 62 may extend through a slot in the side support 30 such that there can be a handle (not shown) on the outside of the support 30. The handle may be connected to the locking pin 62 so as to allow a user to lift the locking pin 62 in the slot and therefore out of its notch 66. With the locking pin 62 lifted out of the notch 66, the gate position may be changed. When one of the gates is lowered into its full down position, the locking pin 62 will drop into the notch associated with that position. The two notches 66 are located so as to be locked in either the front gate down or the rear gate down position. The locking pin 62 is weighted so that it is pulled by gravity into the notch 66 for fixing the gate in position.

What is claimed is:

1. A safety gate for limiting access to a work area, the safety gate comprising:

a support; and a pair of spatially opposed gates pivotally connected to the support, such that as one gate pivots up, the other gate pivots down, each pivoting gate remaining in a position substantially parallel to the position of the other pivoting gate;

wherein the spatially opposed gates are separated by a linkage pivotally mounted at its midpoint to the support;

wherein the each of the opposed gates is pivotally connected to the linkage.

2. A safety gate according to claim 1 further including a latching mechanism for releasably engaging the linkage to maintain the safety gate in a selected position.

3. A safety gate for limiting access to a work area, the safety gate comprising:

a support; and a pair of spatially opposed gates pivotally connected to the support, such that as one gate pivots up, the other gate pivots down, each pivoting gate remaining in a position substantially parallel to the position of the other pivoting gate;

wherein the spatially opposed gates are separated by a linkage pivotally mounted at its midpoint to the support;

wherein the linkage includes a pair of substantially parallel members, each pivotally connected to the support.

4. A safety gate for limiting access to a work area, the safety gate comprising:

a support for positioning on a floor of the work area;

a linkage having opposing ends and being pivotally connected to the support; and a pair of gates, each gate being pivotally mounted to one end of the linkage, such that as the linkage pivots with respect to the support, one gate, while moving in an upward direction, remains substantially perpendicular to the floor, as the other gate, while moving in a downward direction, also remains substantially perpendicular to the floor.

5. A safety gate as set forth in claim 4 wherein the support includes a pair of opposing posts.

6. A safety gate as set forth in claim 5 wherein the linkage includes two pairs of substantially parallel members, each pair being pivotally connected to one of the posts.

7. A safety gate as set forth in claim 4 wherein one of the gates is weighted so that the weight of the one gate tends to pull the linkage downward to move the one gate into a down position relative to the other gate.

8. A safety gate as set forth in claim 4 further including a latching mechanism for releasably engaging the linkage to maintain the safety gate in a selected position.

9. A method for limiting access to a work area, the method comprising the steps of:

providing opposing gates about the work area pivotally movable relative to one another, each gate when in a closed position having a gate height; and pivoting one gate downward into the closed position so as to block a first opening into the work area, while allowing the other gate to pivot upward into an open position at least the gate height above a floor of the work area so as to permit access into the work area beneath the other gate, such that each gate remains substantially perpendicular to the ground and substantially parallel to the other gate.

10. A method as set forth in claim 9 further including step of latching the gates into their respective positions.

11. A safety gate for limiting access to a work area, the safety gate comprising:

a support frame;

opposed stationary gates blocking access in through opposite sides of the work area;

a pair of spatially opposed gates, each gate substantially spanning an end of the work area from one of the opposed stationary gates to the other of the opposed stationary gates, the spatially opposed gates being pivotally connected to the support frames so that as one of the spatially opposed gates pivots up, the other of the spatially opposed gates pivots down to block access through one end of the work area, each of the spatially opposed gates remaining substantially perpendicular to the ground while pivoting.

12. A safety gate according to claim 11 further including a latching mechanism for releasably engaging the gates to maintain the safety gate in a selected position.

13. A safety gate for limiting access to a work area, the safety gate comprising:

a support frame; and stationary gating about the work area having two access openings to the work area;

a pair of gates spaced apart and pivotally connected to the support frame, each gate when in a closed position having a gate height, such that as one gate pivots up above one of the two access openings, the other gate pivots down into the closed position to block the other of the two access openings, each pivoting gate remaining in a position substantially perpendicular to the ground while pivoting;

wherein with the other gate in the closed position, the one gate is in an open position above a floor of the work area by at least the gate height at the one of the two access openings to permit access into the work area beneath the one gate.

14. A safety gate according to claim 13 wherein the pair of gates are separated by a linkage pivotally mounted at its midpoint to the support.

15. A safety gate according to claim 14 wherein each of the gates is pivotally connected to the linkage.

16. A safety gate according to claim 14 wherein the linkage includes a pair of substantially parallel members, each pivotally connected to the support.

17. A safety gate according to claim 13 further including a latching mechanism for releasably engaging the linkage to maintain the safety gate in a selected position.

18. A salary gate according to claim 13 wherein the pair of gates remain substantially parallel to one another while pivoting.

* * * * *

UNITED STATES PATENT AND TRADEMARK OFFICE

CERTIFICATE OF CORRECTION

PATENT NO. : 5,701,701

DATED : December 30, 1997

INVENTOR(S) : Robert M. Desrosiers

It is certified that error appears in the above-identified patent and that said Letters Patent is hereby corrected as shown below:

Column 6, line 35, change "salary" to --safety--

Signed and Sealed this

Seventh Day of April, 1998

Bruce Lehman

*Attest:*

BRUCE LEHMAN

*Attesting Officer*

*Commissioner of Patents and Trademarks*